US008397324B2

(12) United States Patent
Hayes et al.

(10) Patent No.: US 8,397,324 B2
(45) Date of Patent: Mar. 19, 2013

(54) HINGE FOR BED FRAME ASSEMBLY

(75) Inventors: Stephen Hayes, Dudley (GB); Stephen Holl-Yoak, Kingswinford (GB)

(73) Assignee: Huntleigh Technology Limited (GB)

( * ) Notice: Subject to any disclaimer, the term of this patent is extended or adjusted under 35 U.S.C. 154(b) by 706 days.

(21) Appl. No.: 11/995,964

(22) PCT Filed: Jul. 17, 2006

(86) PCT No.: PCT/GB2006/002653

§ 371 (c)(1),
(2), (4) Date: Jun. 9, 2008

(87) PCT Pub. No.: WO2007/010234

PCT Pub. Date: Jan. 25, 2007

(65) Prior Publication Data

US 2008/0282469 A1 Nov. 20, 2008

(30) Foreign Application Priority Data

Jul. 20, 2005 (GB) ..... 0514926.5
Nov. 14, 2005 (GB) ..... 0523169.1

(51) Int. Cl.
*A47D 7/00* (2006.01)

(52) U.S. Cl. ..... 5/618; 5/174; 5/282.1; 5/286

(58) Field of Classification Search ..... 5/613, 617, 5/618, 620, 174, 282.1, 286; 403/161, 162, 403/292, 156
See application file for complete search history.

(56) References Cited

U.S. PATENT DOCUMENTS

| | | | | |
|---|---|---|---|---|
| 3,013,281 | A | 12/1961 | Steiner | |
| 3,051,965 | A | 9/1962 | Szemplak et al. | |
| 3,209,379 | A | 10/1965 | Reinhold | |
| 3,355,695 | A | 11/1967 | Overesch et al. | |
| 4,183,015 | A | 1/1980 | Drew et al. | |
| 4,805,265 | A | 2/1989 | Ehm et al. | |
| 5,398,357 | A | 3/1995 | Foster et al. | |
| 5,542,151 | A * | 8/1996 | Stranski et al. | 16/326 |
| 5,634,532 | A | 6/1997 | Bucher et al. | |
| 5,732,423 | A | 3/1998 | Weismiller et al. | |
| 5,862,551 | A | 1/1999 | Oguma et al. | |
| 5,987,673 | A | 11/1999 | Smith | |
| 6,212,713 | B1 | 4/2001 | Kuck et al. | |
| 6,321,878 | B1 | 11/2001 | Mobley et al. | |
| 6,389,622 | B1 | 5/2002 | Her et al. | |

(Continued)

FOREIGN PATENT DOCUMENTS

| | | | |
|---|---|---|---|
| DE | 35 16 081 | A1 | 11/1986 |
| DE | 199 12 335 | A1 | 9/2000 |

(Continued)

*Primary Examiner* — William Kelleher
(74) *Attorney, Agent, or Firm* — Craig A. Fieschko, Esq.; DeWitt Ross & Stevens S.C.

(57) ABSTRACT

A hinge assembly (32-36) for a frame assembly (20) of for example, a hospital bed, has a smooth outer form which substantially conforms to the outer size of frame assembly struts to which it couples. The hinge assembly (32-36) has its components located internally and provides at least one reliable electrically conductive path therethrough so as to provide an electrical connection between frame struts (24-30) coupled together by the hinge (32-36), avoiding the need for electrical wires. There are provided angle markers on the hinge to indicate the degree of rotation of the hinge halves (50 52).

14 Claims, 4 Drawing Sheets

U.S. PATENT DOCUMENTS

| | | | | |
|---|---|---|---|---|
| 6,486,792 | B1 | 11/2002 | Moster et al. | |
| 6,505,365 | B1 | 1/2003 | Hanson et al. | |
| 6,789,280 | B1 | 9/2004 | Paul | |
| 6,796,565 | B2 * | 9/2004 | Choi et al. | 280/47.35 |
| 7,406,729 | B2 | 8/2008 | Hornbach et al. | |
| 7,533,429 | B2 | 5/2009 | Menkedick et al. | |
| 2005/0028281 | A1 | 2/2005 | Ooyama et al. | |
| 2005/0039263 | A1 | 2/2005 | Reed et al. | |
| 2007/0220677 | A1 | 9/2007 | Dewert | |

FOREIGN PATENT DOCUMENTS

| | | | |
|---|---|---|---|
| DE | 101 41 491 | A1 | 3/2003 |
| EP | 0 381 293 | A | 8/1990 |
| EP | 0 561 749 | A | 9/1993 |
| EP | 0 788 786 | A2 | 8/1997 |
| EP | 1 408 190 | A | 4/2004 |
| EP | 1 435 211 | A | 7/2004 |
| FR | 2 711 520 | A | 5/1995 |
| GB | 603 530 | A | 6/1948 |
| GB | 1 134 417 | A | 11/1968 |
| GB | 2 311 000 | A | 9/1997 |
| WO | WO 96/01066 | A | 1/1996 |
| WO | WO 98/11858 | A | 3/1998 |
| WO | WO 2004/107923 | A | 12/2004 |

* cited by examiner

HINGE FOR BED FRAME ASSEMBLY

FIELD OF THE INVENTION

The present invention relates to a bed frame assembly and in particular to a hinge structure for a configurable bed frame.

BACKGROUND OF THE INVENTION

Configurable bed frame assemblies have been known for many years. These are provided with a bed frame formed of various portions which can be pivoted relative to one another to configure the bed from a flat configuration to different raised configurations. Typically, the portions include a back rest, a thigh rest and a leg rest. Some beds are also provided with a seat rest between the back rest and the thigh rest. The various portions can be moved or pivoted to raise a patient into a sitting position, to raise a patient's legs only to assist in vascular flow and so on.

Such configurable beds have also for many years been controlled electrically, being provided with a plurality of electrically operated actuators which allow for the bed configuration to be changed by pressing one or more buttons on a key pad. Electrical systems are increasingly being incorporated into such beds to provide other functions and facilities.

An example of a prior art bed assembly is the applicant's well known Contoura range of hospital beds.

The various portions of the bed are typically connected by hinges, either directly to one another or through connecting elements such as supports integral with a bed sub-frame. The hinges are typically provided by bolts and nuts passing through two or more circular apertures in adjacent frame elements or brackets to be coupled pivotally together. These hinges can cause a number of problems in maintaining the bed, particularly in a hospital or care home environment. The hinges tend to form protrusions beyond the pivoted frame elements, which must be covered in order to protect patients and users and also to prevent the accumulation of dirt at the site of the hinges. Thus, the use of tarpaulins or other covers is commonplace in the industry. However, it is not possible to keep such tarpaulins and other covers totally clean, particularly in the current medical environments where "super-bugs" such as MRSA (Methicillin-Resistant Staphylococcus Aureus) and the like can quickly develop. This has resulted in the need to carry out extensive cleaning maintenance procedures often taking a bed out of service for significant periods of time.

The provision of an electrical supply to such a bed also means that all metallic parts of the bed must be electrically coupled to a fixed voltage, typically ground. This has necessitated the provision of electrical wires connecting together all the metal components and connecting to ground. Where possible, these wires are located within the cavity of hollow members by welding and then externally to any members which do not have any such cavity. These wires, although performing an essential electrical function, add complexity to the manufacture and structure of the bed and represent another source of possible failure and areas for collection of dirt.

SUMMARY OF THE INVENTION

The present invention seeks to provide an improved bed assembly and hinge structure of a bed assembly.

According to an aspect of the present invention, there is provided a frame assembly for a configurable bed including a plurality of movable frame portions formed from one or more frame struts and a hinge assembly including first and second hinge parts each provided with an integral connecting member, each connecting member being able to fit to respective frame struts, the hinge having an outer perimeter which presents a substantially flat surface with one or more outer surfaces of the frame struts to which it connects.

The term substantially flat surface is intended to refer to a surface which does not present a substantial protrusion from the frame struts which could trap dirt or which requires physical separation from a user such as by a cover or tarpaulin. Advantageously, the hinge has an outer perimeter which presents a substantially flat surface with all of outer surfaces of the frame struts to which it connects.

Preferably, the hinge connecting members are able to fit within tubular frame struts. Alternatively, the connecting members are able to fit over an outer surface of the frame struts.

Advantageously, the first and second hinge parts have internal hinge couplings. Thus, no hinge coupling element needs to be provided outside of the flush outer perimeter of the hinge assembly.

Preferably, the hinge assembly is electrically conductive such that a conductive path is provided through the assembly from one of the connecting members to the other. This enables the hinge to provide the electrical coupling between adjacent frame struts without the need for separate electrical wires.

Advantageously, the hinge assembly includes an electrically conductive hinge bush provided between the first and second hinge parts. The bush is preferably an interference fit with one of the hinge parts and abuts the other hinge part. The bush assists in providing a reliable electrical path between the first and second hinge parts and it has been found that this is more than sufficient and permanent. However, in some instances it is envisaged that the hinge assembly will be provided with an electrically conductive spring element therewithin. The spring element in one embodiment is a coil spring located around the bush and abutting internal walls of the first and second hinge parts. In another embodiment, the spring element is located between the bush and one of the hinge parts, for example a Belleville spring or similar.

Advantageously, the first and second connecting members are provided with a fastening element, in the preferred embodiment, an aperture able to receive an electrically conductive rivet or other electrically conductive fastener which would fasten together the hinge connectors to their respective frame strut, thereby providing an even more secure mechanical and electrical coupling.

According to another aspect of the present invention, there is provided a hinge assembly including first and second hinge parts each provided with an integral connecting member, the assembly being electrically conductive such that a conductive path is provided through the assembly from one connecting member to the other.

Advantageously, the hinge assembly includes an electrically conductive hinge bush provided between the first and second hinge parts. The bush is preferably an interference fit with one of the hinge parts and abuts the other hinge part.

In an embodiment the hinge assembly is provided with an electrically conductive spring element therewithin. The spring element in one embodiment is a coil spring located around the bush and abutting internal walls of the first and second hinge parts.

Advantageously, the first and second connecting members are provided with a fastening element, in the preferred embodiment an aperture able to receive an electrically conductive rivet or other electrically conductive fastener which would fasten together the hinge connectors to their respective frame strut.

According to another aspect of the present invention, there is provided a frame assembly for a bed including a hinge structure as herein specified.

According to another aspect of the present invention, there is provided a bed including a hinge structure as herein specified.

BRIEF DESCRIPTION OF THE DRAWINGS

Embodiments of the present invention are described below, by way of example only, with reference to the accompanying drawings, in which.

DETAILED DESCRIPTION OF PREFERRED EMBODIMENTS OF THE INVENTION

Figure 1:
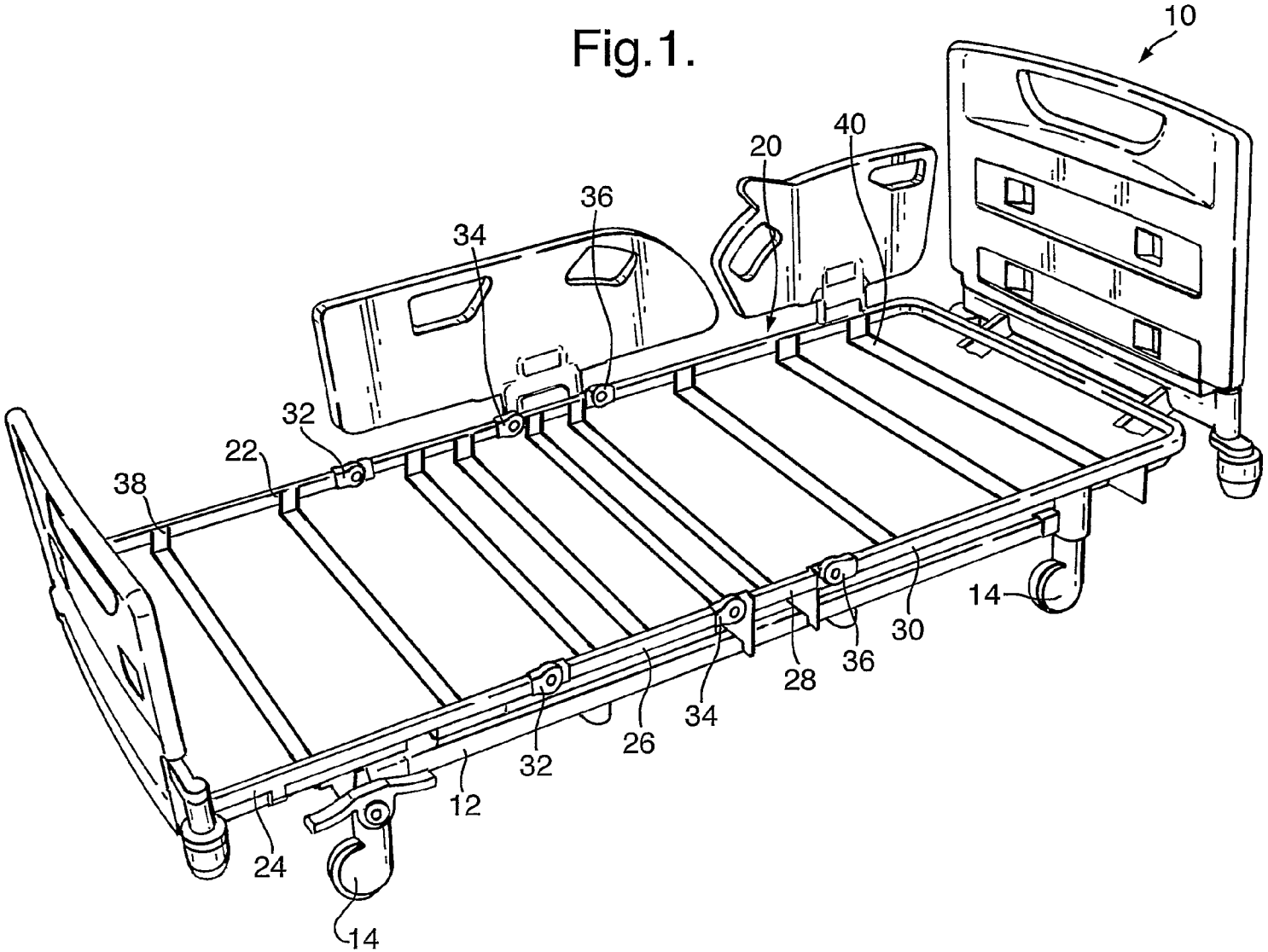
FIG. 1 shows a perspective view of an embodiment of frame assembly.

Referring to FIG. 1, there is shown a preferred embodiment of bed assembly 10 which includes a wheeled base 12 provided with four castors 14 of conventional type. Coupled to the base 12 is a bed platform 20 which can be raised and lowered relative to the base 12 and tilted by means of one or more electrical actuators (not shown), also of conventional type.

The platform 20 is provided with a frame 22 formed, in this embodiment, of four frame sections 24, 26, 28 and 30 which are coupled to one another by means of hinged joints 32, 34 and 36.

Each frame section 24-30 is provided with an upper frame member having substantially vertical inner side walls 38 and a plurality of depending transverse struts 40 to form a recessed support surface for supporting a plurality of mattress support panels, described in the applicant's co-pending British patent application numbers 0514926.5 and 0523184.0.

The hinges 32, 34 and 36 are provided in the upper frame members 24-30 and enable the frame members to pivot relative to one another about the hinges 32-36.

The frame 22 is typically made of metal or a metal alloy. The frame struts are, in this embodiment, tubular but could be substantially solid if preferred.

As will be apparent from FIG. 1, in this embodiment the frame sections 24-30 are formed from struts which are of rounded rectangular form in transverse cross-section. Of course, any other cross-section could be used but it is preferred that the outer form is smooth and has rounded corners. A circular outer profile is a suitable alternative.

The hinges 32-36 have an outer form which complements the outer form of the frame struts and present substantially flat inner and outer surfaces to the frame 20. There are no features of the hinges which protrude laterally beyond the frame sections to require special provision such as covering to protect a patient or care staff.

Figure 2:
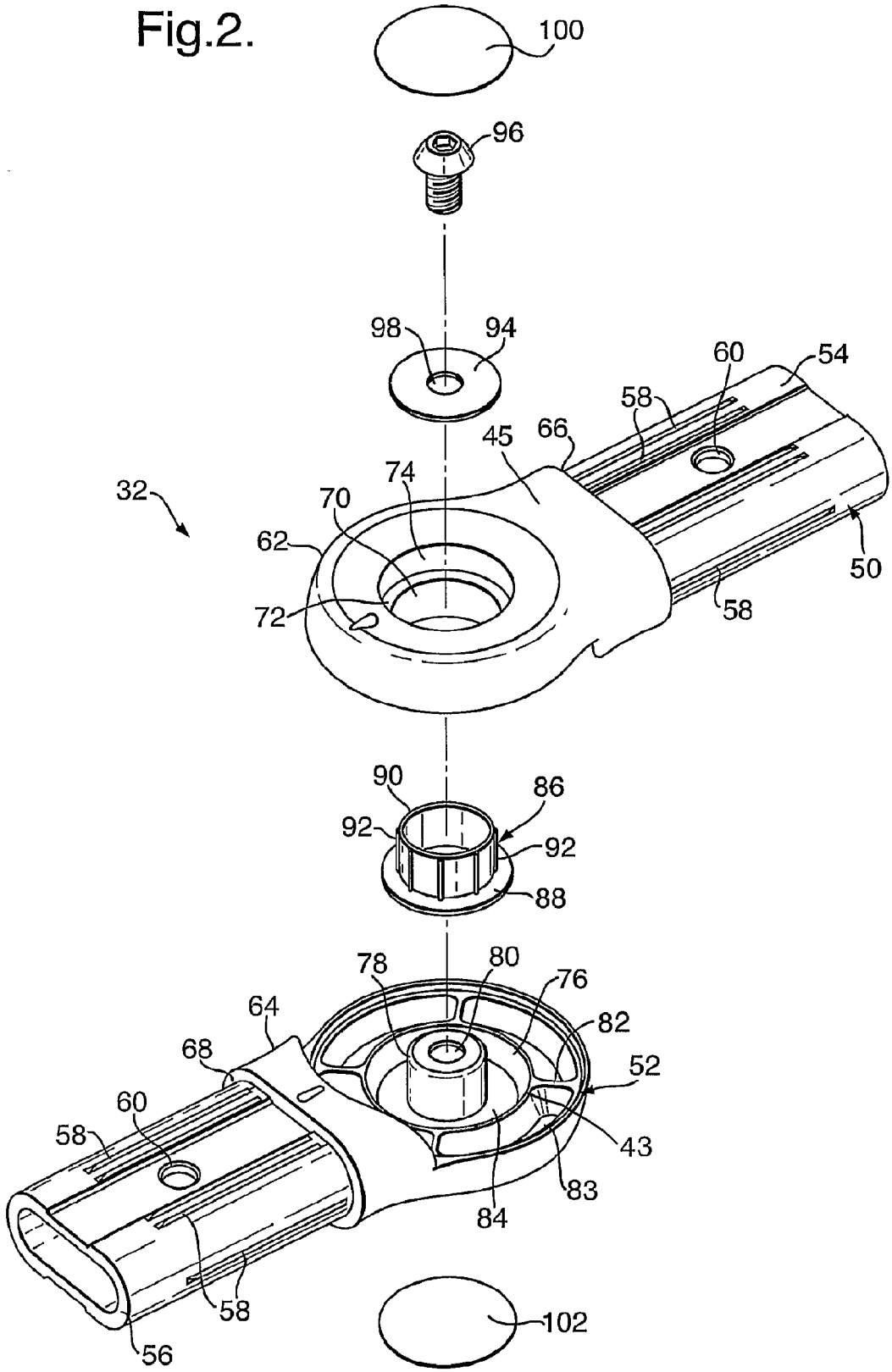
FIG. 2 is an exploded view of the preferred embodiment of coupling hinge.

Referring now to FIG. 2 there is shown in exploded form a preferred embodiment of assembly forming the hinges 32-36. Each hinge, which is made substantially entirely of metal, is formed of metal or metal alloy hinge halves 50, 52 which are externally substantially identical to each other although this is not strictly necessary. The hinge halves 50, 52 are pivotally joined to each other with the inner face 43 of the first hinge half 52 facing the inner face of the second hinge half 50 (this inner face not being visible in FIG. 2), and with the outer faces 45, 47 (FIG. 3) of the hinge halves 50, 52 facing outwardly.

Each hinge half 50, 52 includes a connector element 54, 56 of a rounded rectangular outer form which is of a size to fit tightly within the inner cavity of the tubular frame struts 24-30. There is provided a plurality longitudinally extending metal or metal alloy ribs 58, triangular in transverse cross-section, around the periphery of the connecting elements 54, 56 which will dig into the internal surface of the frame struts 24-30 and which will thereby assist in producing a strong mechanical and electrical coupling between the frame struts and the hinge parts 54, 56.

Each connecting element 54, 56 is also provided with a circular aperture 60 which in use receives a metal rivet 55, 57 (shown in FIG. 3) or other suitable fastener which passes through a corresponding aligned hole in the associated frame strut. Such rivet or other fastener can fix the two elements together and guarantee a good electrical coupling, although this feature is not always necessary. A rivet is preferred because of improved assembly and because it can provide a smooth rounded outer surface, which is not possible with a bolt or the like.

Figure 3:
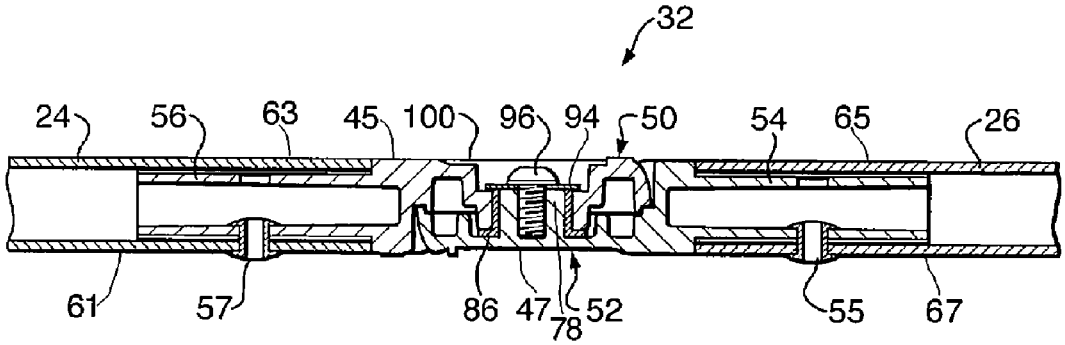
FIG. 3 is a cross-sectional view of the hinge of FIG. 2.

The connecting elements 54, 56 are integral with their respective hinge body members 62, 64, which members provide a shoulder 66, 68 at the junction with their respective connecting element 54, 56 of a height substantially identical to the thickness of the tubular strut such that the outer faces 45, 47 of the hinge body members 62, 64 provide a substantially smooth transition to the adjacent surfaces of the frame struts 24, 26, as can be seen in FIG. 3. Thus, as seen in FIG. 3, the outer face 45 of the second hinge half 50 is substantially flush with the inner face 65 of the first frame strut 26 (as well as with the outer face 63 of the second frame strut 24), and the outer face 47 of the first hinge half 52 is substantially flush with the inner face 61 of the second frame strut 24 (as well as with the outer face 67 of the first frame strut 26).

The hinge half 50 includes an inner tubular section 70 which provides a shoulder 72 which itself is at the base of a tubular recess 74.

The hinge half 52 includes an inner annular wall 76 circumscribing an annular boss 78, which boss is provided with a round aperture 80 therein. Coupling the wall 76 to the outer wall 83 of the hinge half 52 are a plurality of radially spaced strengthening ribs 82. Similar ribs may be provided in the hinge half 50 between the walls 70 and 74 and the outer wall of that hinge half.

The space between the wall 76 and the boss 78 of the hinge half 52 presents an annular base wall 84.

A hinge bush 86, made of metal or metal alloy in this embodiment, includes an annular base 88 and an upstanding annular wall 90 which is provided with a plurality of radially spaced longitudinally extending ribs 92. The annular base 88 of the hinge bush 86 fits into the recess formed by the wall 76 and boss 78 of the hinge half 52 and when assembled touches in rotatable manner the base wall 84, as best seen in FIG. 3. The upstanding annular wall 90, on the other hand is an interference fit into the annular wall 70 of the hinge half 50 and in practice rotates with that hinge half.

The assembly includes a washer 94 which, when fitted, sits on the shoulder 72 and which provides an upper stop to the position of the upstanding wall 90 of the bush 86. A screw fixing, in this example a button head screw 96 fits through the aperture 98 of the washer 94 and, in the preferred embodiment, engages with threads of threaded aperture 80 in the boss 78 of the hinge half 52. In other embodiments, the screw 96 has an internally threaded bore (not shown) which is then fixed to a bolt fitted into the boss 78 from the underside of the hinge half 52 when viewed in the orientation of FIG. 2.

The washer 94, in combination with the screw 96, acts to urge the bush 86 against the base wall 84 of the hinge half 52, for which the upstanding wall 90 is designed to be suitably high, thereby ensuring a consistent and reliable contact and thus in practice a reliable electrical connection between the two hinge halves 50, 52. Of course, since all the components of the hinges 32-36 are preferably of conductive material, a plurality of conductive paths is typically present, thereby ensuring a good electrical connection during all the positions of the hinge.

Should it be considered necessary, there could be provided an electrically conductive sprung element within the hinge assembly. In one embodiment, there is provided a coil spring, which would fit around the upstanding wall 90 of the bushing and within the annular wall 70, of such dimensions that it is compressed against the inner surface of annular wall 76 of the hinge half 52 and against the inner surface of a similar wall (not shown) in the hinge half 50, in a manner which would be immediately apparent to a person skilled in the art. Alternatively, a Belleville spring or washer could be placed between the base wall 84 of the hinge half 52 and the annular base 88 of the bush 86.

First and second cover panels 100, 102 fit over the recesses provided by the walls 74 and of the boss 78 (on the underside of the hinge half 52 when viewed in the orientation of FIG. 2) to provide a smooth outer surface to the hinge assembly. These cover panels could be of any suitable material and their coupling to the hinge body will be apparent to the skilled person, there being a variety of fixing methods known in the art.

As will be apparent from FIG. 2, the two hinge halves 50, 52 nest within one another.

Figure 4:
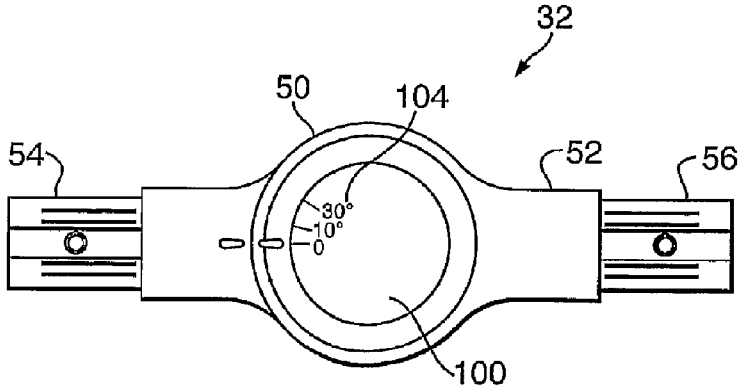
FIG. 4 is a front view of the preferred embodiment of hinge assembly.
Figure 5:
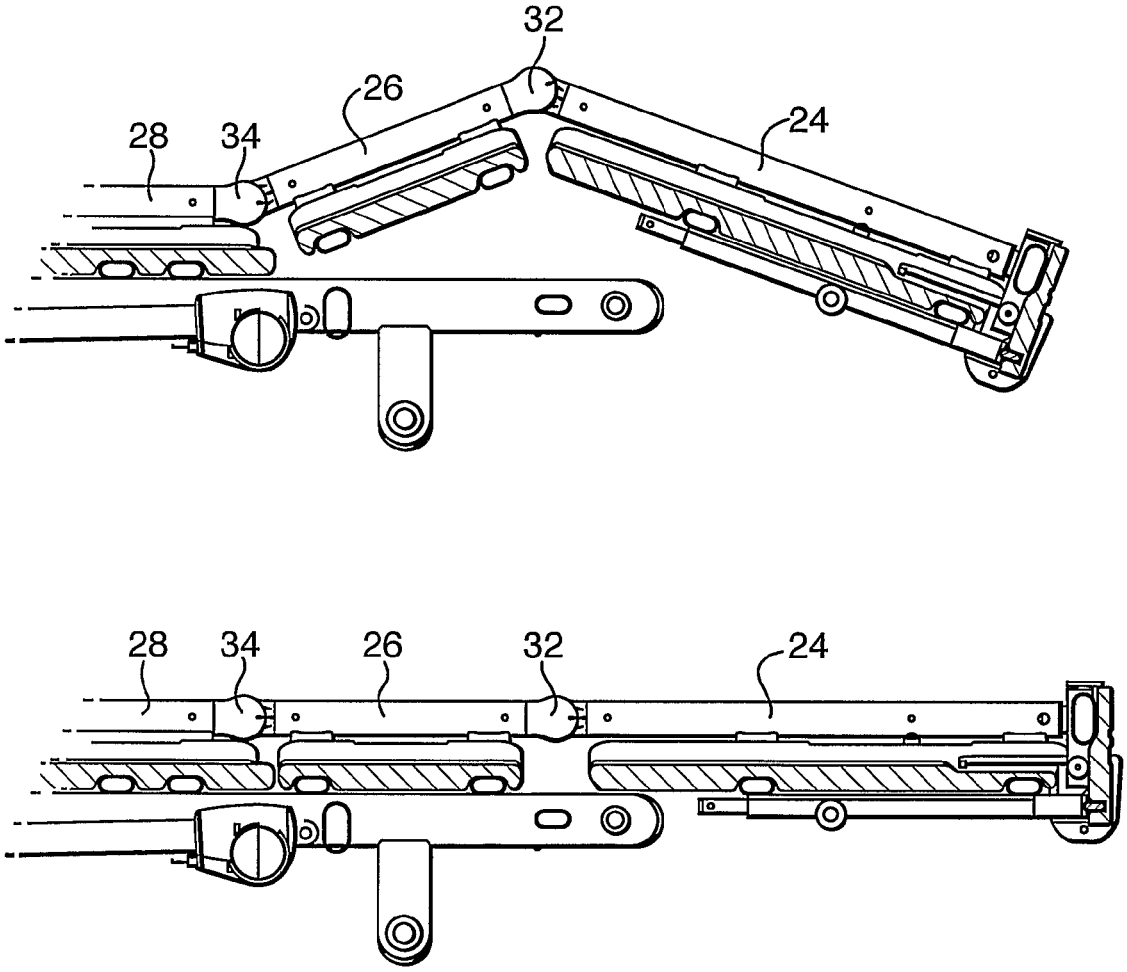
FIG. 5 is a side elevational view of an example of hospital bed showing a portion of the configurable frame in a bent configuration.

Referring now to FIG. 4, there is shown a front view of the hinge of FIG. 2 in assembled form. The hinge cover 100 is provided with a plurality of angle markings 104. These note the angle between the two hinge halves 50, 52 and in practice between two frame struts coupled together by the hinge 32-36, as shown in FIG. 5. Such markings are useful during the assembly of the bed frame.

Although the hinge assemblies are shown as fitting into the bed frame sections, it is envisaged that this coupling could be reversed. For example, for frame sections which are solid, the connecting members of the hinge halves could fit over the ends of respective frame struts, which struts could be provided with ends of reduced outer dimensions to provide shoulders similar to the shoulders 66, 68 shown in FIG. 2.

The hinge assembly and its various components could be made of a material other than metal or metal alloy as long it can conduct electricity from one frame strut to another.

The invention claimed is:

1. A frame assembly for a configurable bed including:

a. first and second frame struts, each including:

(1) an inner face, (2) an opposing outer face, and (3) a terminal end, b. a hinge assembly pivotally joining the frame struts about a pivot axis, the hinge assembly including:

(1) first and second hinge body members, each hinge body member including:

(a) an inner face, wherein:

(i) the inner face of each hinge body member faces the inner face of the other hinge body member, and (ii) the inner face of the first hinge body member includes an integral boss extending therefrom and having a passage extending therein, the boss being rotatably received within the inner face of the second hinge body member, (b) an outer face opposite the inner face, and (c) a side edge extending between the inner face and the outer face, wherein the hinge body members are pivotally joined with the pivot axis extending therebetween through the inner and outer faces of the hinge body members, (2) first and second connecting members, each:

(a) extending from the side edge of a respective one of the hinge body members, (b) including:

(i) an inner face extending along planes adjacent to the inner face of the respective hinge body member, and (ii) an opposing outer face extending along planes adjacent to the outer face of the respective hinge body member, (c) being joined to the terminal end of a respective one of the frame struts such that:

(i) the inner face of the first frame strut faces the same direction as the inner face of the first hinge body member, and (ii) the inner face of the second frame strut faces the same direction as the inner face of the second hinge body member, wherein:

I. the inner face of the first frame strut is situated at least substantially coplanarly with:

i. the outer face of the second hinge body member, and ii. the outer face of the second frame strut, II. the inner face of the second frame strut is situated at least substantially coplanarly with:

i. the outer face of the first hinge body member, and ii. the outer face of the first frame strut, and III. the first and second frame struts rest at least partially within the same planes.

2. The frame assembly of claim 1 wherein each frame strut has a hollow terminal end, with:

a. the first connecting member being fit within the hollow terminal end of the first frame strut, and b. the second connecting member being fit within the hollow terminal end of the second frame strut.

3. The frame assembly of claim 2 wherein the connecting members include one or more ribs protruding therefrom, wherein the ribs engage the interiors of the hollow terminal ends of the frame struts.

4. The frame assembly of claim 1 further including an at least substantially incompressible bushing:

a. interposed between, and b. spacing apart, the inner face of the first hinge body member and the inner face of the second hinge body member.

5. The frame assembly of claim 1:

a. further including a washer fastened upon the boss;

b. wherein the second hinge body member is situated between the washer and the inner face of the first hinge body member.

6. The frame assembly of claim 1 further including a bushing which is fit about the boss, wherein the bushing spaces the boss from the inner face of the second hinge body member.

7. The frame assembly of claim 6 wherein the bush bushing is electrically conductive.

8. The frame assembly of claim 6 wherein the bushing:

a. has an at least substantially circular outer circumference, and b. the circular outer circumference includes one or more protruding ribs which extend radially to engage an at least substantially circular inner circumference of the inner face of the second hinge body member.

9. The frame assembly of claim 6 wherein the bushing is force-fit with interference within the inner face of the second hinge body member.

10. The frame assembly of claim 1:

a. wherein the inner face of the first hinge body member includes:

(1) a boss extending therefrom, and (2) an annular groove about the boss, b. further including a bushing which is fit about the boss, wherein the bushing includes an annular flange extending radially outwardly therefrom, with the annular flange resting within the annular groove against the inner face of the first hinge body member.

11. The frame assembly of claim 1 further including an electrically conductive member fit in compression against both the second hinge body and the inner face of the first hinge body member.

12. The frame assembly of claim 1 wherein the inner face of the second hinge body member includes an elongated tubular wall extending therefrom, wherein the tubular wall closely surrounds a boss rotatably received therein.

13. The frame assembly of claim 12 further including a bushing sandwiched between the boss and the tubular wall.

14. The frame assembly of claim 13 wherein the bushing includes an annular flange extending radially outwardly therefrom, with the annular flange being sandwiched between the tubular wall and the inner face of the first hinge body member.

* * * * *